US005769412A

United States Patent [19]

Takemoto et al.

[11] Patent Number: 5,769,412

[45] Date of Patent: Jun. 23, 1998

[54] PAPER SLIP STORAGE UNIT

[75] Inventors: Takatoshi Takemoto, Tokyo; Yoshio Ito; Motohiro Sugawara, both of Hanamaki, all of Japan

[73] Assignee: Kabushiki Kaisha Ace Denken, Tokyo, Japan

[21] Appl. No.: 702,577

[22] PCT Filed: Mar. 3, 1995

[86] PCT No.: PCT/JP95/00346

§ 371 Date: Sep. 3, 1996

§ 102(e) Date: Sep. 3, 1996

[87] PCT Pub. No.: WO95/23757

PCT Pub. Date: Sep. 8, 1995

[30] Foreign Application Priority Data

Mar. 3, 1994 [JP] Japan ..... 6-033888

[51] Int. Cl.[6] ..... B65H 29/70

[52] U.S. Cl. ..... 271/188; 271/119; 271/314; 271/220; 271/177; 271/178; 271/198; 271/226; 271/190; 271/191; 271/192

[58] Field of Search ..... 271/119, 314, 271/220, 177, 178, 198, 226, 188, 190, 191, 192

[56] References Cited

FOREIGN PATENT DOCUMENTS

| | | |
|---|---|---|
| 0 038 918 | 11/1981 | European Pat. Off. . |
| 0 407 152 A2 | 1/1991 | European Pat. Off. . |
| 1 142 879 | 1/1963 | Germany . |
| 31 43 762 | 6/1982 | Germany . |
| 60-130250 | 8/1985 | Japan . |
| 61-37658 | 2/1986 | Japan . |
| 61-183050 | 8/1986 | Japan . |
| 62-79143 | 4/1987 | Japan . |
| 62-140043 | 9/1987 | Japan . |
| 63-82273 | 4/1988 | Japan . |
| 1-48768 | 2/1989 | Japan . |
| 2-81865 | 3/1990 | Japan . |
| 2-106553 | 4/1990 | Japan . |
| 3-64972 | 6/1991 | Japan . |
| 4-140261 | 5/1992 | Japan . |
| 5-92839 | 4/1993 | Japan . |

*Primary Examiner*—Joseph E. Valenza
*Assistant Examiner*—Wonki Park
*Attorney, Agent, or Firm*—Seed and Berry LLP

[57] ABSTRACT

A first shaft 21 and a second shaft 31 parallel with each other are provided near an inlet 14 of a bill storage chamber 10. Taking-in runners 20 are disposed on the first shaft 21 and taking-in rollers 30 are disposed on the second shaft 31. The taking-in runners 20 and the taking-in rollers 30 differ in position in a direction in which the shafts extend. Further, the sum of the radius of each taking-in runner 20 and that of each taking-in roller 30 is larger than the spacing between the first shaft 21 and the second shaft 31. Thus, if a plurality of overlapped bills are caught in the space between the taking-in runners 20 and the taking-in rollers 30, they are bent in a wavy form and the intimate contact force between the bill is lowered significantly, causing the bills to be easily aligned.

4 Claims, 3 Drawing Sheets

PAPER SLIP STORAGE UNIT

TECHNICAL FIELD

This invention relates to a paper slip storage unit for aligning and storing a plurality of transported bills.

TECHNICAL BACKGROUND

For example, a conventional paper slip storage unit is described in Japanese Patent Laid-Open No. Sho 62-79143. This storage unit comprises a storage chamber for storing a plurality of bills in a state in which the bills are piled up in a vertical direction so that paper faces of the bills become horizontal, a feed roller and a separation roller which are placed facing each other, a plurality of conveyor belts and a plurality of transport rollers for feeding bills passing through between the rollers into the storage chamber, etc. The storage unit rotates only the feed roller so as to allow bills arriving upstream from the feed and separation rollers to be fed downward and feeds downward only bills coming in contact with the feed roller even when a plurality of bills overlap each other, thereby separating the overlapped bills. It transports the separated bills one by one to the storage chamber on the conveyor belts, etc.

However, after overlapped bills are separated by feed and separation rollers, such a storage unit requires conveyor belts, etc., for feeding the separated bills to the storage chamber; the structure is complicated, costs are increased, and the unit becomes large.

The storage unit piles a plurality of bills in a vertical direction so that paper faces of the bills become horizontal. However, if the paper faces of bills are oriented in the vertical direction and an attempt is made to pile bills in a horizontal direction, gravity does not act in the bill piling direction, and thus the bills cannot be stored in a packed manner.

DISCLOSURE OF INVENTION

It is therefore a first object of the invention to provide a paper slip storage unit having a simple structure and capable of aligning and storing transported bills.

It is a second object of the invention to provide a paper slip storage unit capable of densely storing bills regardless of the paper slip piling orientation.

To accomplish the first object, there is provided a paper slip storage unit comprising:

a storage chamber having an inlet for taking in the paper slips and a stopper face vertical to a transport direction of the plurality of paper slips, sides of the paper slips taken in through the inlet coming in contact with the face;

two shafts being parallel with each other and parallel with the stopper face near the inlet of the storage chamber;

a plurality of first rotors being attached to one of the two shafts, which will be hereinafter referred to as the first shaft, and rotating together with the first shaft;

second rotors being attached to the other of the two shafts, which will be hereinafter referred to as the second shaft, and rotating together with the second shaft; and a taking-in drive mechanism for rotating the first and second shafts so that the paper slips caught in the space between the first and second rotors can be fed in a direction of the stopper face of the storage chamber, characterized in that the second rotors disposed on the second shaft differ from the first rotors disposed on the first shaft in position in a direction in which the two shafts extend, and that the sum of the radius of the first rotor and that of the second rotor is larger than spacing between the first and second shafts.

In such a paper slip storage unit, when a transported paper slip is caught in the space between the first and second rotors, it is sent through the inlet to the storage chamber. At this time, since the first and second rotors differ in position in the shaft direction, the paper slip between the first and second rotors is bent in a wavy form. Thus, when a plurality of paper slips are transported while they overlap, the intimate contact force between the overlapped bills is lowered significantly and the bills easily slide with respect to each other. Resultantly, for example, if two bills are transported in a slightly shifted relationship in the transport direction, when one of the bills first comes in contact with the stopper face of the storage chamber, the other bill slides in relation to the one bill until it comes in contact with the stopper face of the storage chamber, and the sliding of the other bill from the one bill in the transport direction disappears. Therefore, a plurality of paper slips can be neatly aligned and stored in a simple structure.

To accomplish the second object, there is provided a paper slip storage unit comprising:

a storage chamber having an inlet for taking in the paper slips, a stopper face vertical to a transport direction of the plurality of paper slips, sides of the paper slips taken in through the inlet coming in contact with the face, and a paper slip support face being vertical to the stopper face and opposed to the faces of the paper slips taken in through the inlet;

two shafts parallel with each other and parallel with the stopper face near the inlet of the storage chamber;

a plurality of first rotors being attached to one of the two shafts, which will be hereinafter referred to as the first shaft, and rotating together with the first shaft;

second rotors being attached to the other of the two shafts, which will be hereinafter referred to as the second shaft, and rotating together with the second shaft;

a taking-in drive mechanism for rotating the first and second shafts so that the paper slips caught in the space between the first and second rotors can be fed in a direction of the stopper face of the storage chamber;

a third shaft being placed on the opposite side to the paper slip support face with the paper slips fed into the storage chamber by rotation of the first and second rotors as the center, the third shaft being parallel with the first and second shafts;

a runner being attached to the third shaft and having a plurality of flexible blades extending radially from the third shaft; and a pushing drive mechanism for rotating the third shaft.

In such a paper slip storage unit, when a transported paper slip is caught in the space between the first and second rotors, it is sent through the inlet to the storage chamber. A plurality of paper slips entering the storage chamber come in contact with the stopper face of the storage chamber and are aligned in the transport direction. Also, the paper slips entering the storage chamber are pushed in the direction of the paper slip support face by the pushing runners. Therefore, the paper slips entering the storage chamber are pushed in sequence in the direction of the paper slip support face, so that the storage density can be raised.

BEST MODE FOR CARRYING OUT THE INVENTION

Referring now to the accompanying drawings, there is shown one embodiment of a paper slip storage unit according to the invention.

The paper slip storage unit of the embodiment, which is a bill storage unit, is placed at one end of a pachinko (Japanese pinball) machine island, for example. Bills input to a pachinko ball lending machine in the pachinko machine island are transported by transport means in the pachinko machine island to the storage unit.

Figure 1:
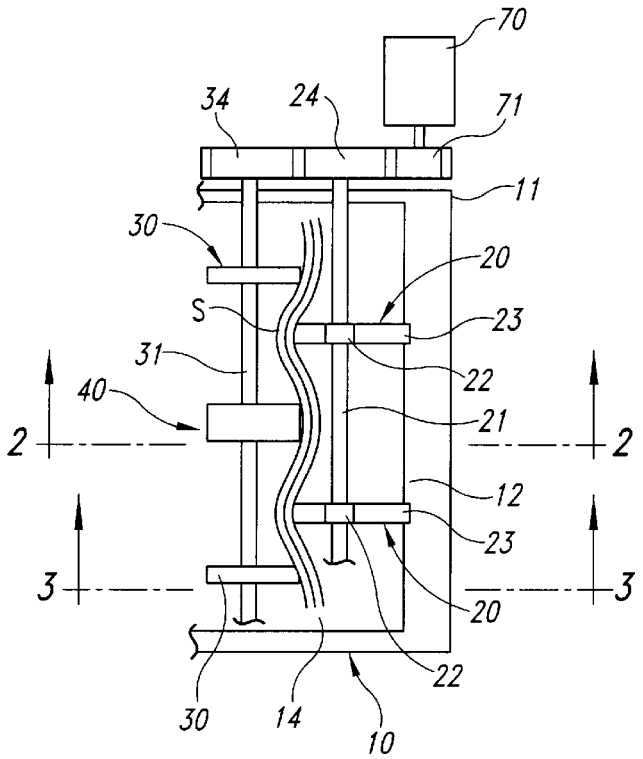
FIG. 1 is a plan view of a bill storage unit of one embodiment according to the invention.
Figure 2:
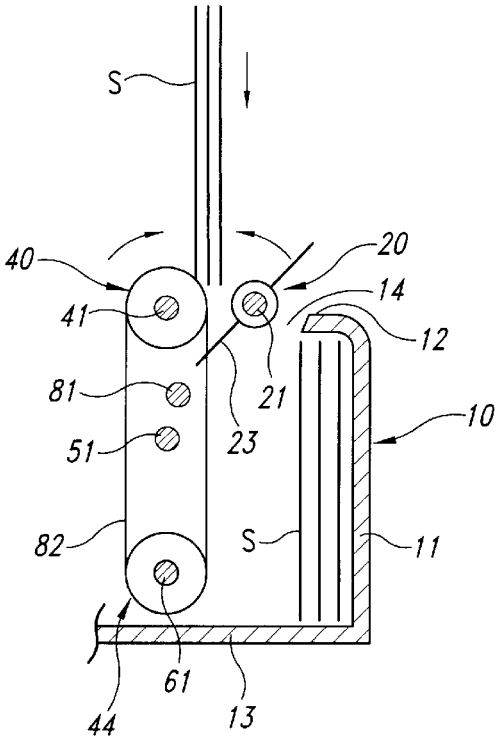
FIG. 2 is a sectional view taken on line II—II in FIG. 1.
Figure 3:
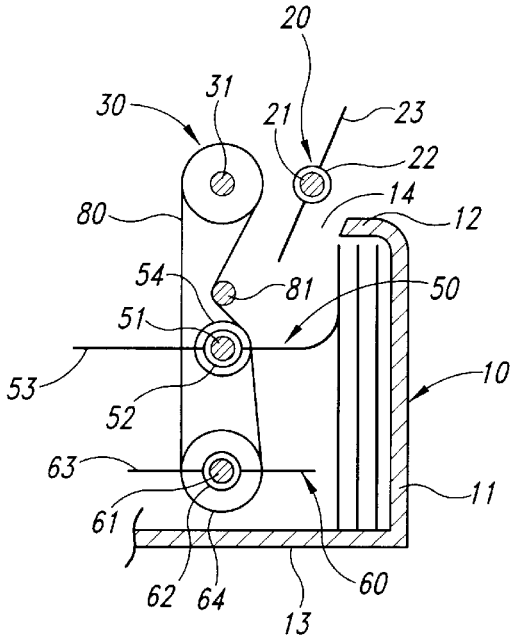
FIG. 3 is a sectional view taken on line III—III in FIG. 1.

As shown in FIGS. 1–3, the bill storage unit of the embodiment comprises a storage chamber 10 for storing bills S, taking-in runners (first rotors) 20 and taking-in rollers (second rotors) 30 and 40 for taking bills S into the storage chamber 10, and pushing runners 50 and 60 for pushing the taken-in bills S deep into the storage chamber 10.

As shown in FIG. 3, the storage chamber 10 has a side board 11 having an inner face serving as a paper slip support face, a top board 12, and a bottom board 13 having an inner face serving as a stopper face, and these boards 11, 12, and 13 define a storage space shaped like a rectangular parallelopiped capable of storing a plurality of bills S. The top board 12 is formed with an inlet 14 for taking bills S into the storage space. As shown in FIG. 2, each bill S is fed vertically from above through the inlet 14 into the storage chamber 10 with short sides of the bill oriented in the vertical direction and long sides oriented in the horizontal direction.

Two shafts 21 and 31 parallel with the long sides of bills S fed vertically from above are provided near the inlet 14 of the storage chamber 10. One of the two shafts 21 and 31, which will be hereinafter referred to as a first shaft, 21, is provided with two taking-in runners 20 and 20. The taking-in runner 20 has cylindrical shaft attachment parts 22 attached to the first shaft 21 and a plurality of blades 23, 23, . . . extending radially from the shaft attachment parts 22. For example, the blade 23 is formed of a material which is flexible and has a large friction coefficient against the bill, such as urethane rubber.

As shown in FIG. 1, the other shaft 31, which will be hereinafter referred to as a second shaft, is provided with two first taking-in rollers 30 and 30 and one second taking-in roller 40. The second taking-in roller 40 is located almost at the center of the second shaft 31 in a shaft extending direction. The first taking-in rollers 30 and 30 are located on the sides of one end and an opposite end of the second shaft 31, with the second taking-in roller 40 as the center.

The taking-in runners 20 are attached to the first shaft 21 so that they are placed in different positions from the first taking-in rollers 30 and the second taking-in roller 40 in the direction in which the shafts 21 and 31 extend. The first taking-in roller 30 has the same radius as the second taking-in roller 40. The sum of the radius of each taking-in runner 20 disposed on the first shaft 21 and that of the first taking-in rollers 30 or the second taking-in roller 40 disposed on the second shaft 31 is larger than the spacing between the first shaft 21 and the second shaft 31. Therefore, if bills are caught in the space between the taking-in runners 20 and the first taking-in rollers 30 and the second taking-in roller 40, they are bent in a wavy form.

The first shaft 21 is provided at one end with a first gear 24. The second shaft 31 is provided at one end with a second gear 34 meshing with the first gear 24. A drive gear 71 rotated by a drive source 70 also meshes with the first gear 24. Thus, as the drive gear 71 rotates, the first gear 24 and the second gear 34 also rotate, turning the first shaft 21 and the second shaft 31. Resultantly, the taking-in runners 20 and the first taking-in rollers 30 and the second taking-in roller 40 also rotate. However, since the second gear 34 meshes with the first gear 24 and rotates in an opposite direction to the rotation of the first gear 24, the taking-in runners 20 attached to the first shaft 21 and the first taking-in rollers 30 and the second taking-in roller 40 attached to the second shaft 31 rotate in opposite directions.

In the storage chamber 10, a third shaft 51 and a fourth shaft 61 are provided in parallel with the second shaft 31 just below the second shaft 31, as shown in FIG. 3. The third shaft 51 is provided with the first pushing runner 50 and the fourth shaft 61 is provided with the second pushing runner 60. The pushing runner 50, 60 has a cylindrical shaft attachment part 52, 62 attached to the shaft 51, 61 respectively and a plurality of blades 53, 63 extending radially from the shaft attachment part 52, 62. The blades 53 and 63 are formed of a material which is flexible and has a small friction of coefficient against bills, such as plastic films. The radius of the first pushing runner 50 is almost equal to the distance from the third shaft 51 to which the first pushing runner 50 is attached to the side board 11 of the storage chamber 10. The radius of the second pushing runner 60 is slightly shorter than that of the first pushing runner 50. Here, the radius of the first pushing runner 50 is made greater than that of the second pushing runner 60, but the radius of the second pushing runner 60 may be made greater than that of the first pushing runner 50 depending on the bill condition.

Driven pulleys 54 and 64 are attached to the shaft attachment parts 52 and 62 of the pushing runners 50 and 60, respectively, so as to be adjacent thereto. The driven pulleys 54 and 64 of the pushing runners 50 and 60 are located just below the first taking-in rollers 30 disposed on the second shaft 31. An endless belt 80 is placed on the driven pulleys 54 and 64 of the pushing runners 50 and 60 and the first taking-in roller 30. A tension pulley 81 circumscribes the endless belt 80 to raise contact pressure between the driven pulley 54 of the first pushing runner 50 and the endless belt 80. Therefore, as the first taking-in roller 30 rotates, the pushing runners 50 and 60 also rotate in the same direction as the first taking-in roller 30.

As shown in FIG. 2, a driven pulley 44 is attached to the fourth shaft 61 at a position just below the second taking-in roller 40. An endless belt 82 is placed on the driven pulley 44 and the second taking-in roller 40. Therefore, as the second taking-in roller 40 rotates, the driven pulley 44 also rotates in the same direction as the second taking-in roller 40.

Next, the operation of the bill storage unit of the embodiment will be discussed.

When the drive source 70 drives, the drive gear 71, the first gear 24, and the second gear 34 rotate, turning the taking-in runners 20, the first taking-in rollers 30, and the second taking-in roller 40. As the first taking-in rollers 30 rotate, the first pushing runner 50 and the second pushing runner 60 also rotate.

Thus, when the runners 20, 50, and 60 and the taking-in rollers 30 and 40 rotate, if a bill S is transported to the space between the taking-in runners 20, 20 and the taking-in rollers 30, 30, 40 vertically from above, it is caught in the space between the taking-in runners 20, 20 and the taking-in rollers 30, 30, 40 and is bent in a wavy form in its long side direction, as shown in FIG. 1. Thus, when a plurality of bills are transported while overlapping, the intimate contact force between the overlapped bills is lowered significantly and the bills easily slide with respect to each other.

Resultantly, for example, if two bills are transported while slightly shifted in their short side direction, when one of the bills first comes in contact with the inner face (stopper face) of the bottom board 13 of the bill storage chamber 10, the other bill slides in relation to the one bill until it comes in contact with the bottom board 13 of the storage chamber 10, and the shift of the other bill from the one bill in the short side direction disappears. At this time, unlike the embodiment, if the mutual intimate contact force between the two bills is not lowered, the one bill first coming in contact with the bottom board 13 of the storage chamber 10 is pushed in the short side direction by the other bill, and becomes wrinkled, etc. If bills are wrinkled, when a plurality of bills are piled up, the bill piling density decreases and when the bills in the storage chamber 10 are again transported later, a paper jam will also be caused.

Figure 4:
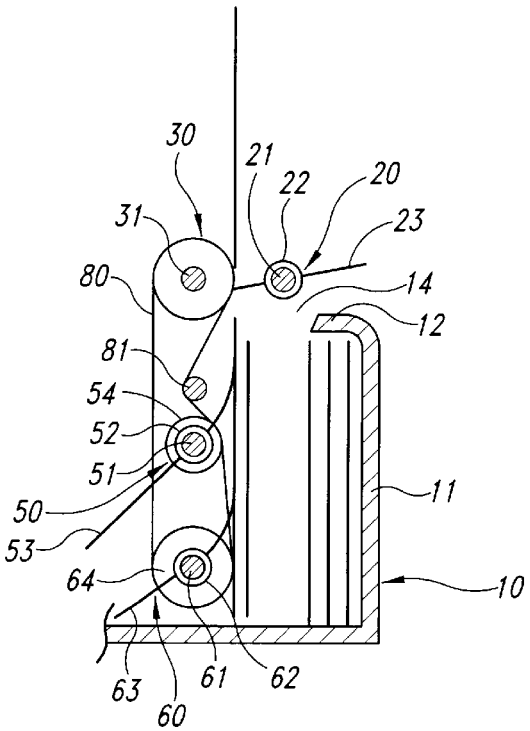
FIG. 4 is a sectional view of the bill storage unit of the embodiment according to the invention while bills are taken into the unit.

If three bills are transported while overlapping, as shown in FIG. 2, the bill coming in contact with the taking-in runner 20 and the bill coming in contact with the taking-in roller 30 are taken into the storage chamber 10 and then the bill sandwiched between the two bills is taken in after the bills at both sides are taken in, as shown in FIG. 4.

Figure 5:
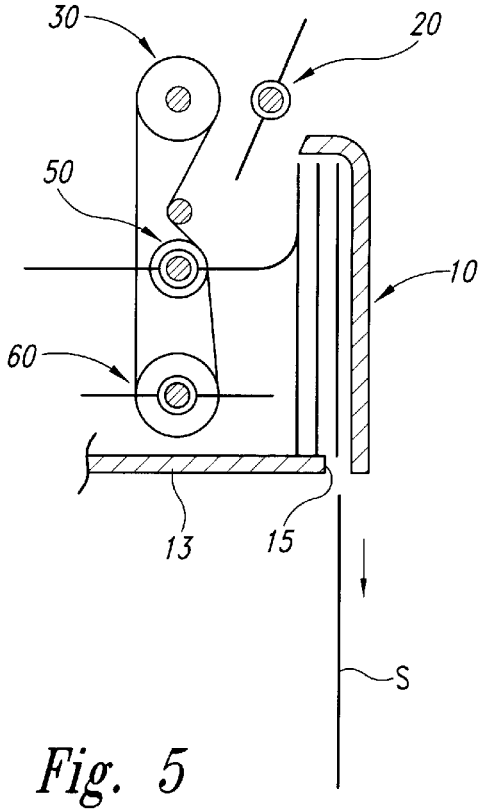
FIG. 5 is a sectional view of the bill storage unit of another embodiment according to the invention.

The bills S taken into the storage chamber 10 are pushed to the side of the side board 11 of the storage chamber 10 in sequence by the pushing rollers 50 and 60. As a result, the bills are piled up in intimate contact with each other in the horizontal direction. Therefore, they can be stored in a good condition in which wrinkles or the like are unlikely to occur, and the bill storage density can be increased. As shown in FIG. 5, if an outlet 15 is made in the bottom board 13 of the storage chamber 10 and the storage chamber 10 is used as a temporary storage chamber, the bills S pushed by the pushing runners 50 and 60 are discharged in sequence through the outlet 15.

Figure 6:
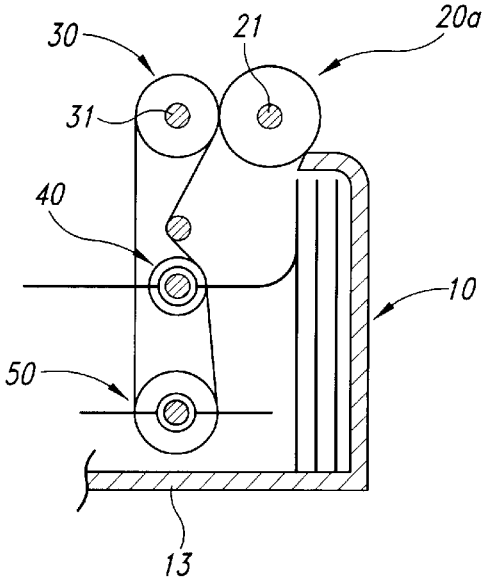
FIG. 6 is a sectional view of the bill storage unit of still another embodiment according to the invention.

As shown in FIG. 6, a taking-in roller 20*a* may be used in place of the taking-in runner 20 in the embodiment. Also in this case, the sum of the radius of the taking-in roller 20*a* disposed on the first shaft 21 and that of the taking-in roller 30 disposed on the second shaft 31 needs to be made larger than the spacing between the first shaft 21 and the second shaft 31.

We claim:

1. In a paper slip storage unit for storing a plurality of paper slips transported from a given direction, a paper slip storage unit comprising:

a storage chamber having an inlet for taking in said plurality of paper slips, a stopper face perpendicular to a transport direction of the paper slips, sides of the paper slips taken in through said inlet coming in contact with the face, and a paper slip support face being perpendicular to said stopper face, to which paper faces of the paper slips taken in through said inlet are opposed;

two shafts being parallel with each other and opposed to and parallel with said stopper face near said inlet of said storage chamber;

a plurality of first rotors being attached to one of said two shafts, which will be hereinafter referred to as said first shaft, and rotating together with said first shaft;

second rotors being attached to the other of said two shafts, which will be hereinafter referred to as said second shaft, and rotating together with said second shaft;

a first gang mechanism, when one of said first and second shafts rotates, for reversely rotating the other shaft so that the paper slips caught in a space between said first and second rotors can be fed in a direction of said stopper face of said storage chamber;

a third shaft being placed on an opposite side to said paper slip support face with the paper slips fed into said storage chamber by rotation of said first and second rotors as a center, said third shaft being parallel with said first and second shafts;

a pushing runner being attached to said third shaft and having a plurality of flexible blades extending radially from said third shaft;

a second gang mechanism for rotating said third shaft by rotation of either of said first and second shafts to rotate said third shaft to which said pushing runner is attached so that the paper slips entering said storage chamber through said inlet can be pushed to a side of said paper slip support face while they are pushed to a side of said stopper face of said storage chamber by said pushing runner; and a drive mechanism for rotating any of said first, second, and third shafts.

2. The paper slip storage unit as claimed in claim 1 wherein said first rotors are runners each having a plurality of flexible blades extending radially from said first shaft, and wherein said second rotors are cylindrical rollers with said second shaft as a center.

3. The paper slip storage unit as claimed in claim 1 wherein said first rotors are cylindrical rollers with said first shaft as a center, and wherein said second rotors are cylindrical rollers with said second shaft as a center.

4. The paper slip storage unit as claimed in claim 1, 2, or 3 further including:

a fourth shaft being placed on an opposite side to said paper slip support face with the paper slips fed into said storage chamber by rotation of said first and second rotors as a center, said fourth shaft being disposed nearer to said stopper face than said third shaft and parallel to said third shaft; and a second pushing runner being attached to said fourth shaft and having a plurality of flexible blades extending radially from said fourth shaft, said second gang mechanism for rotating said third shaft by rotation of either of said first and second shafts and rotating said fourth shaft in the same direction as said third shaft, wherein each blade of said pushing runner attached to said third shaft, which will be hereinafter referred to as said first pushing runner, has a length to allow a tip of the blade to come in contact with said paper slip support face and each blade of said second pushing runner has a length shorter than the blade of said first pushing runner.

* * * * *